US007304657B2

(12) United States Patent
Kido et al.

(10) Patent No.: US 7,304,657 B2
(45) Date of Patent: Dec. 4, 2007

(54) IMAGE PROCESSING APPARATUS, METHOD, AND PROGRAM

(75) Inventors: Kazuhiro Kido, Hino (JP); Mamoru Umeki, Hachioji (JP)

(73) Assignee: Konica Minolta Medical & Graphic, Inc. (JP)

( * ) Notice: Subject to any disclaimer, the term of this patent is extended or adjusted under 35 U.S.C. 154(b) by 245 days.

(21) Appl. No.: 11/149,864

(22) Filed: Jun. 10, 2005

(65) Prior Publication Data

US 2005/0276621 A1 Dec. 15, 2005

(30) Foreign Application Priority Data

Jun. 15, 2004 (JP) ..... 2004-177502

(51) Int. Cl.
*G03D 13/00* (2006.01)

(52) U.S. Cl. ..... 347/114; 355/27

(58) Field of Classification Search ..... 347/114; 355/27

See application file for complete search history.

(56) References Cited

U.S. PATENT DOCUMENTS

2002/0186294 A1* 12/2002 Torisawa et al. ..... 347/228

2004/0061884 A1* 4/2004 Yamaguchi ..... 358/1.9

FOREIGN PATENT DOCUMENTS

| | | |
|---|---|---|
| JP | 06-233134 | 8/1994 |
| JP | 10-500497 | 1/1998 |

* cited by examiner

*Primary Examiner*—Huan Tran
(74) *Attorney, Agent, or Firm*—Cantor Colburn LLP

(57) ABSTRACT

An image processing apparatus including an exposing device, a developing device, a density measuring device to measure a density value of the developed film sheet, a calibrating device to calibrate the density value based on measured density values of a test image by the density measuring device and by an external density measuring device, a condition change detecting device to detect a condition change of the density measuring device, a correcting device to correct the density value, according to a result of detection by the condition change detecting device and the characteristics variation table showing variations of unmeasured values due to a condition change of the density measuring device, and a controlling device to control at least one of the exposing device and the developing device to optimize a relationship between diagnostic image data and film density according to the corrected density value.

17 Claims, 8 Drawing Sheets

IMAGE PROCESSING APPARATUS, METHOD, AND PROGRAM

This application is based on Japanese Patent Application No. 2004-177502 filed on Jun. 15, 2004 in the Japanese Patent Office, the entire content of which is hereby incorporated by reference.

BACKGROUND OF THE INVENTION

The present invention relates to apparatuses, methods, and programs for image processing. Specifically, this invention relates to those which can make printouts (hard copies) of stable densities from diagnostic image data.

As an image processing apparatus containing a densitometer, a digital laser imaging system (hereinafter referred to as an imager) equipped with a densitometer has been known as described, for example, in Patent Document 1. The densitometer in the imager is used to control the gradation characteristics of the imager and the final film (hard copy) density. For example, the built-in densitometer is used to measure the densities of patches which are recorded on a prescribed position of a film in order to control image densities by the so-called calibration process which includes the steps of exposing the film to form a latent image of multiple step wedges by prescribed exposure signals, developing the film to make the latent image visible, measuring the final density of each of the step wedges, and creating a look-up table (LUT) which determines exposure amount for inputted diagnostic image data to optimize the final film gradation characteristics from the result of this measurement, or by the feedback correction processing (FB correction processing) which determines the feedback correction values to optimize the image density of the next film.

When a hospital has two or more imagers, an external standard densitometer, in addition to the built-in densitometer of respective imagers, is generally used to manage the print densities of the imagers to check whether the final print densities are within the predetermined allowable range. In other words, the resulting density graduations controlled according to the result of measurement by the built-in densitometers in the imagers are compared with the final film density gradations measured by this external standard densitometer to check whether the density gradations are in the predetermined allowable range.

If the density gradations are not in the predetermined allowable range, the densitometers must be corrected to eliminate the difference in readouts between the built-in densitometers and the external standard densitometer. Specifically, it is common to measure the densities of the printed film by the external standard densitometer, to compare the readouts between the built-in densitometers and the external standard densitometer, and to correct the values measured by the built-in densitometers to eliminate the difference between the readouts. This correction is made because, if the readouts between the external standard densitometer and the built-in densitometer of an imager are kept different while the image density is constant, the respective imagers produce films of different image densities after exposure and development processes in the patch density control (patch feedback) system (hereinafter, referred to as the FB correction) and this may cause management problems.

The FB correction controls film densities by forming a rectangular area (patch area) of about 5×10 mm on a prescribed location of each film with a prescribed exposure amount, measuring its finished density, comparing the measured density value with a target density value, and controlling the exposing and/or developing conditions to optimize the density of the subsequent film according to the difference.

In the FB correction using the density of the above rectangular area measured by the external standard densitometer, when the target density is 2.0, based on the measured density (of 1.9 for example), the density control can be effective by correcting to eliminate this difference (0.1=2.0−1.9)(the density of the subsequent film is increased by +0.1). However, in the FB correction using the density of the above rectangular area measured by the built-in densitometer, if the readout of the built-in densitometer is 2.0 due to an error even though the readout of the external standard densitometer is 1.9, the density correction is not carried out if the target density is set as 2.0, and the effective density control will not be carried out.

Imagers of the heat development type which are described in Patent Document 2 have been popular as imagers each of which houses a densitometer. This type of imager develops a film to make the latent image visible by heating while conveying the film. Therefore, a built-in densitometer on the downstream side of the heat developing section tends to be thermally affected by hot films. Further, when the densitometer is housed in a downsized imager which has been desired recently, the densitometer is also thermally affected by the heating means directly. Therefore, the built-in densitometer must be thermally stable in a wide temperature range. If this thermal characteristic is not satisfied, the finished film density may be affected.

The thermal errors of such a densitometer may be suppressed when its components have good temperature characteristics. However, such components may increase the component cost. A cooling fan can be one of good methods for suppressing thermal influence on the built-in densitometer by keeping the surrounding temperature within a predetermined temperature range, but it occupies a space in the imager and increases cost. Although a cooling fan can reduce the thermal influence on a densitometer to some degree, the densitometer cannot substantially be free from thermal influence.

[Patent Document 1] Tokkai Hei 6-233134

[Patent Document 2] Tokuhyou Hei 10-500497

After the above problems were carefully studied and researched, it was found that stable image densities could be obtained without frequent calibrations of built-in densitometer by measuring densities at various temperatures by the respective built-in densitometers, creating a characteristics variation table of each built-in densitometer based on the measured density values, and correcting the values measured by the densitometer after the calibration of the densitometer according to the characteristics variation table of the densitometer, which has led to the present invention.

An object of the present invention is to provide apparatuses, methods, and programs for image processing which can make film sheets of stable image densities without measurement errors of a built-in densitometer caused by thermal variations.

SUMMARY OF THE INVENTION

The above object can be achieved-by the following apparatus, method and program.

(A) An image processing apparatus, comprising an exposing device to expose a film sheet to form a latent image on the film sheet based on data of a diagnostic image or data of a test image, a developing device to develop the film sheet exposed by the exposing device to visualize the latent image, a density measuring device to measure a density value of the film sheet developed by the developing device, a calibrating device to obtain a calibration value from a calculation process carried out based on a result of density measurement of the test image by the density measuring device and a result of density measurement of the test image by an external density measuring device which is different from the density measuring device and to calibrate the density measuring device according to the calibration value, a storing device to store a characteristics variation table showing variations of measured values due to a condition change of the density measuring device, a condition change detecting device to detect a condition change of the density measuring device when the density value of a film of the diagnostic image is measured and when the calculation process is carried out, a correcting device to correct a density value of the calibrated density measuring device, according to a result of detection by the condition change detecting device and the characteristics variation table stored in the storing device.

(B) An image processing method, comprising steps of exposing a film sheet to form a latent image on the film sheet based on data of a diagnostic image or data of a test image, developing the film sheet exposed in the step of exposing to visualize the latent image, measuring a density value of the film sheet developed in the step of developing, with a density measuring device, calibrating the density measuring device, according to a calibration value obtained by a calculation process carried out based on a result of density measurement of the test image by the density measuring device and a result of density measurement of the test image by an external density measuring device which is different from the density measuring device, detecting a condition change of the density measuring device when the density value of a film of the diagnostic image is measured and when the calculation process is carried out, correcting a density value of the density measuring device calibrated in the step of calibrating, according to a result of detection obtained in the step of detecting and a previously stored characteristics variation table showing variations of measured values due to a condition change of the density measuring device.

(C) An image processing program for implementing an image processing method (b), stored in an image processing apparatus.

DETAILED DESCRIPTION OF THE PREFERRED EMBODIMENT

Figure 1:
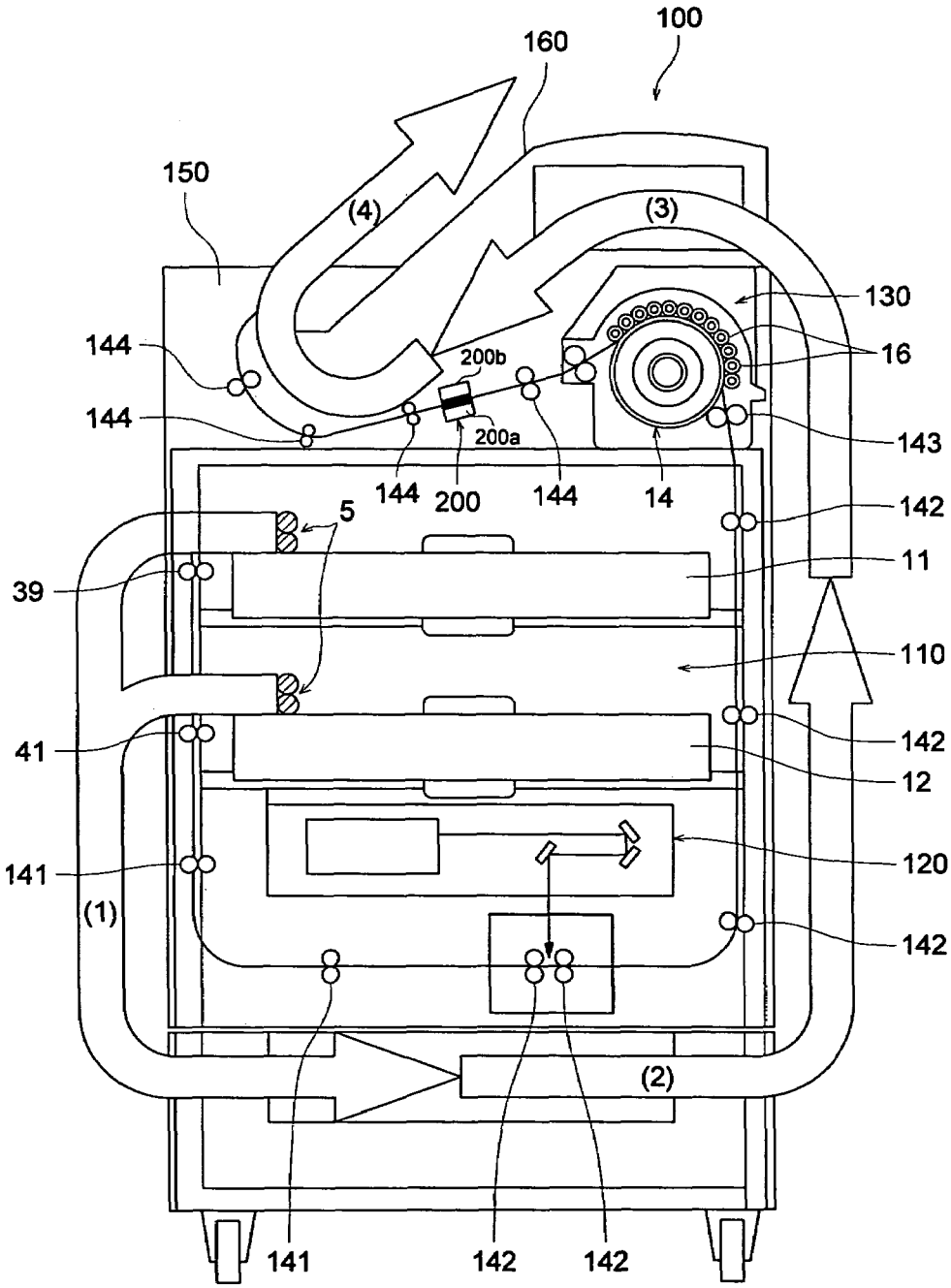
FIG. 1 is a front view of main parts showing a structural example of the image processing apparatus of the present invention.

Preferred embodiments to achieve the aforementioned objective of this invention will be explained.

(1) The image processing apparatus (A), further comprising a controlling device to control at least one of the exposing device and the developing device to optimize a relationship between diagnostic image data and film density according to a density value corrected by the correcting device.

(2) The image processing apparatus (A), wherein the controlling device creates a calibration look-up table (LUT) which determines a relationship between the diagnostic image data and an exposure amount and a latent image is formed by the exposing device according to the calibration look-up table (LUT).

(3) The image processing apparatus (A), wherein the controlling device controls exposure and development of a printout according to next diagnostic image data by a patch feedback system.

(4) The image processing apparatus (A), wherein the developing device is of a heat development type which develops the film sheet by heating to visualize the latent image.

(5) The image processing apparatus (A), wherein the condition change of the density measuring device is a temperature change of the density measuring device.

(6) The image processing apparatus (A), wherein the condition change of the density measuring device is a time lapse starting from a time at which the density measuring device is energized.

(7) The image processing apparatus (A), wherein the correcting device corrects the time lapse according to a history of film processing.

(8) The image processing method (B), further comprising step of controlling at least one of the exposing device and the developing device to optimize a relationship between diagnostic image data and film density according to a density value corrected in the step of correcting.

(9) The image processing method (B), wherein in the step of controlling, a calibration look-up table (LUT) which determines a relationship between diagnostic image data and an exposure amount is created and a latent image is formed according to the calibration look-up table in the step of exposing.

(10) The image processing method (B), wherein in the step of controlling, exposure and development of a printout are controlled according to next diagnostic image data by a patch feedback system.

(11) The image processing method (B), wherein in the step of developing, a developing device of a heat development type is employed, which develops the film sheet by heating to visualize the latent image.

(12) The image processing method (B), wherein the condition change of the density measuring device is a temperature change of the density measuring device.

(13) The image processing method (B), wherein the condition change of the density measuring device is a time lapse starting from a time at which the density measuring device is energized.

(14) The image processing method (B), wherein in the step of correcting, the time lapse is corrected according to a history of film processing.

In order to achieve the aforementioned objective, another preferred embodiment will be explained.

This invention can provide apparatuses, methods, and programs for image processing which can output stable densities without being affected by errors in a built-in densitometer due to temperature variations.

Embodiments of the present invention will be explained below.

Since it is preferable that the image processing apparatus, the image processing method and the program of the present invention are applied to an image processing apparatus employing a so called heat developing method in which a latent image formed by exposure on a film sheet is developed by heating so as to exhibit good effects of this invention, an explanation as an example will be given referring to such an image processing apparatus of heat developing method.

Figure 2:
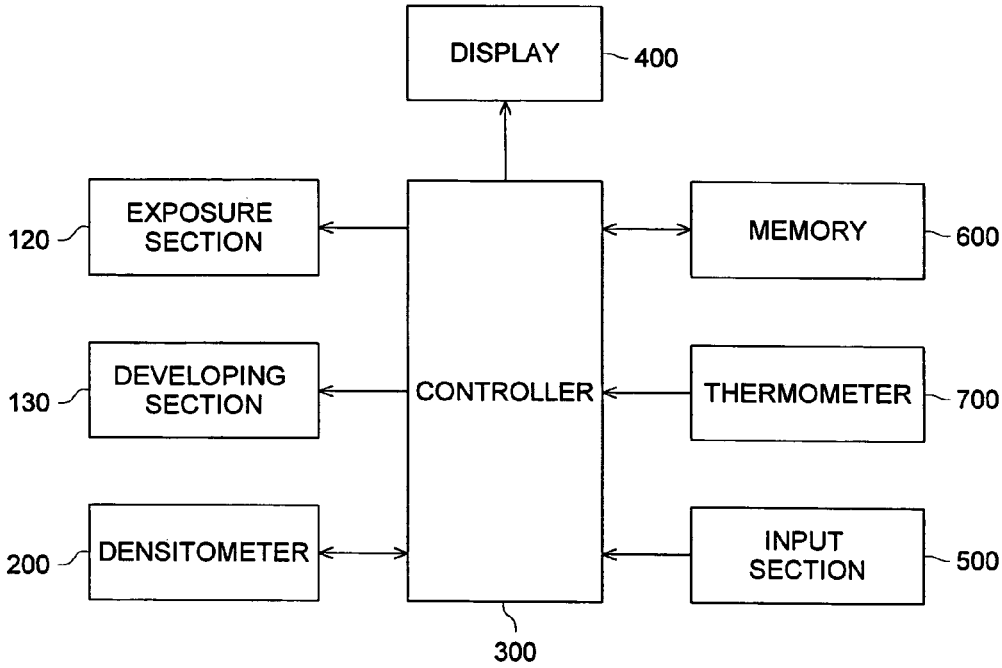
FIG. 2 is a block diagram showing a structure of the image processing apparatus of the present invention.

FIG. 1 is a view showing an example of the internal structure of an image processing apparatus related to the present invention, and FIG. 2 is a block diagram showing a structure of the major parts of the image processing apparatus. Here, a medical laser imager for printing diagnostic images is illustrated as the image processing apparatus.

As shown in FIG. 1, image processing apparatus 100 is composed of feeding section 110 incorporating first and second loading sections 11 and 12 for loading a package containing a specified number of sheets of film and supply section 90 for successively conveying sheets of film one after another for exposure and development. Image processing apparatus 100, further includes exposure section 120 which exposes the film supplied from feeding section 110 and which then forms a latent image on the film corresponding to the diagnostic image data, developing section 130 for visualizing the diagnostic image by heat-developing the film carrying a latent image formed thereon, and densitometer 200 for measuring the image density of the developed film and also for obtaining image density information.

Film sheets are sequentially conveyed either from first loading section 11 or second loading section 12 of feeding section 110 in arrowed direction (1) and arrowed direction (2) in FIG. 1 by supply section 90 and paired conveying rollers 39, 41 and 141, which convey individual sheets of film to exposure section 120.

On said film sheet conveyed to exposure section 120, a latent image based on diagnostic image data is formed by being exposed in exposure section 120. The diagnostic image data are obtained by photographing with an image photographing apparatus such as an X-ray imaging apparatus or an MRI imaging apparatus. The exposure amount to be employed in the exposure section 120 is determined according to diagnostic image data while controller 300, shown in FIG. 2, controls exposure section 120, whereby the image density is adjusted.

Controller 300 controls exposure section 120 and/or developing section 130 for exposure and development of the subsequent film processed based on the result of measurement by densitometer 200, to maintain an appropriate relationship between diagnostic image data and the image density of the film. Specifically, controller 300 performs a so called FB (feedback) correction process based on the measured value in the patch area with densitometer 200, as will be described later. At this point, according to this invention, since the result of measurement of densitometer 200 is arranged to be corrected, as will be mentioned below, a densitometer having normal level temperature characteristics can be employed as densitometer 200 so that there is an effect to reduce the total cost of the apparatus.

A film sheet on which a latent image, based on diagnostic image data, has been formed in exposure section 120, is conveyed in arrowed directions (2) and (3) in FIG. 1 to developing section 130 with paired conveying rollers 142.

The film sheet conveyed to developing section 130 is developed by heating in developing section 130. As shown in FIG. 1, developing section 130 is composed of drum 14 which can heat a film sheet while it is held on its outer periphery, and plural rollers 16 which hold the film sheet on drum 14 while pinching the film sheet between rollers 16 and drum 14. Drum 14 incorporates a heater (not illustrated) inside it and heat-develops a film sheet by maintaining the temperature of the film sheet over the prescribed minimum heat development temperature (approx. 110° C. for example). By this means, a latent image formed on the film in the above exposure section 120 is created as a visible image. The heater of drum 14 is controlled by controller 300 the same as for exposure section 120, and further it is possible to adjust the image density of film by changing development temperature due to the change of the heater temperature.

On the left side of developing section 130, cooling and conveying section 150 is provided to cool the heated film, in which plural paired conveying rollers 144 and densitometer 200 are installed. Cooling and conveying section 150 cools a film released from heating drum 14 while conveying it toward the lower left according to arrow (3) in FIG. 1.

While paired conveying rollers 144 convey the film sheet, densitometer 200 measures the image density of the film. The film has a rectangular area of approx. 5×10 mm (a patch area) which has been previously made by being exposed to a light beam of a prescribed light amount for conducting FB correction, at a specific position, and densitometer 200 is controlled to measure the density of this area.

After this, a plurality of paired conveying rollers 144 further convey according to arrow (4) in FIG. 1 and ejects the film onto ejection tray 160 located on the upper right portion of image processing apparatus 100 so that the film can be taken out from the top of the apparatus.

In the present invention, it is sufficient for the densitometer only to be able to measure the density of a film which has been exposed and developed, and only to be set into image processing apparatus 100. For example, a densitometer composed of light emission part 200*a* and light receiving part 200*b* is installed in the apparatus so that a developed film sheet is conveyed between light emission part 200*a* and light receiving part 200*b* as described above, and when the film passes them, a light beam irradiated from light emission part 200*a* passes through the film and is received by the light receiving part 200*b*. A densitometer structured so that the density is measured according to the extent of reduction of the received light amount can be employed.

Image processing apparatus 100 incorporates display 400 such as a liquid crystal panel, as shown in FIG. 2, and input section 500 which receives various kinds of input. Image processing apparatus 100 of this invention can conduct a calibration process, while displaying the measured value of densitometer 200 on display 400 and receiving input of the read value from the external densitometer through input section 500, to calibrate the measured value of densitometer 200 based on the input. This kind of calibration is carried out based on not a diagnostic image but the printed result of test image in image processing apparatus 100.

Figure 3:
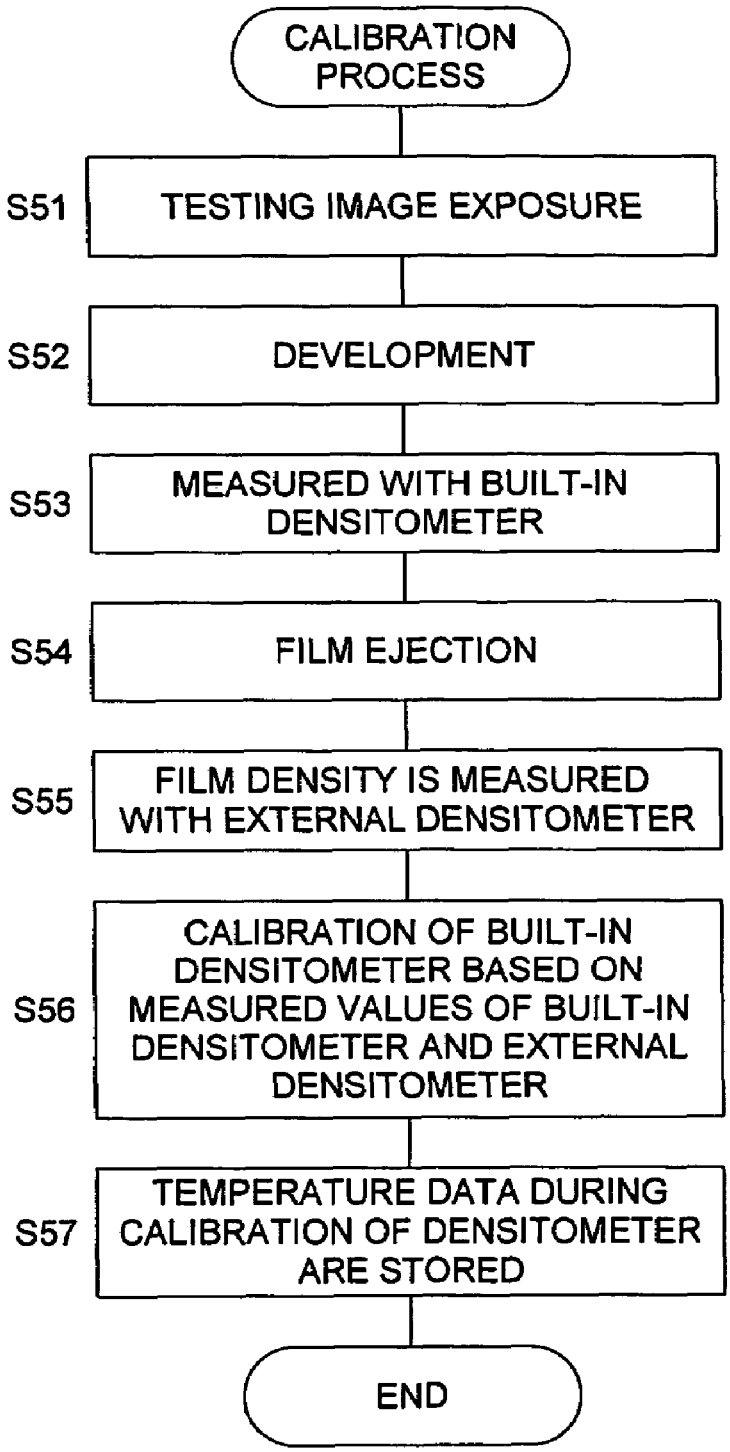
FIG. 3 is a flowchart showing an example of the steps of the calibration process.

The flow of the calibration process will now be explained, according to FIG. 3.

First, in exposure section 120, a prescribed testing pattern (including a plurality of wedge patterns) as a test image is formed by exposure (S51), and the formed testing pattern is developed in developing section 130 (S52). The wedge pattern is a rectangular image which has been formed by exposure and developed at a prescribed density. Next, the density of the wedge patterns formed on the film is measured with densitometer 200 installed in image processing apparatus 100 (S53).

After completion of the processes up to step S53, the film on which wedge patterns have been formed is conveyed by paired conveying roller 144 and ejected from image processing apparatus 100 (S54).

Next, the density of the wedge patterns formed on the ejected film is measured with an external densitometer which is regarded as a standard instrument (not illustrated) outside image processing apparatus 100 (S55). This measurement can be regularly performed by service personnel or the like during maintenance of image processing apparatus 100. The measured value obtained with this external densitometer is accepted by image processing apparatus 100 by means of inputting the value with the above-stated input section 500 by service personnel or the like. At the same time, these information data are displayed on display 400.

In controller 300, when the input operation of the measured value by the external densitometer by a service personnel or the like is completed, first the measured value of densitometer 100 inside image processing apparatus 100 measured during above Step S53 and the measured value of the external densitometer inputted at above Step S55 are compared. Further a calibration value for the calibration of the measured value of densitometer 200 is obtained so that the measured value of internal densitometer 200 measured in Step S53 accords to the inputted measured value of the external densitometer and it is then stored in a prescribed area of memory 600 (S56).

Next, controller 300 detects the condition of densitometer 200 at the time of the calibration process, which will be base data to monitor the condition change of densitometer 200 inside image processing apparatus 100.

The condition change of densitometer 200 has two aspects. One aspect is detected as a condition change from a temperature difference (aspect of temperature) obtained by respectively measuring the temperature of densitometer 200 when the calibration process is carried out, and another temperature of densitometer 200 when the density measurement of a printed image based on diagnostic image data, is carried out. The other aspect is one which is detected as a condition change from a time difference (aspect of time) obtained by respectively measuring the time up to the calibration process and the time up to the moment when density measurement of a printed image formed based on diagnostic image data is carried out, on the condition that the time when densitometer 200 is energized by the power-on operation of image processing apparatus is regarded as the starting point. Here, the case where a detected result is obtained from the aspect of temperature as a condition change will be explained.

The temperature of densitometer 200 at the time of the calibration process is measured with thermometer 700 (illustrated in FIG. 2) installed in image processing apparatus 100 by the control of controller 300. Here, the temperature of densitometer 200 means not only densitometer itself, but also the ambient temperature of the atmosphere in thermally the same system. The measured temperature data are stored in a prescribed area of memory 600 (S57).

Next, the flow of the FB correction process, when a diagnostic image is printed, will be explained referring to FIG. 4.

First, controller 300 exposes a film by controlling exposure section 120, based on given diagnostic image data (S1) and develops a latent image formed by exposure, in developing section 130 (S2). Next, the density of the diagnostic image formed on the film is measured with densitometer 200 installed in image processing apparatus 100 (S3). This measured value is corrected based on the calibration value obtained in the above-stated calibration process. The corrected measured value is temporally stored in a prescribed area of memory 600.

Here, controller 300 detects the condition of densitometer 200 inside image processing apparatus 100, that is, the temperature of it with thermometer 700, and stores the temperature data into a prescribed area of memory 600.

Next, the correction process is carried out (S5). This correction process will be explained referring to FIG. 5.

In this correction process, controller 300 reads out two sets of temperature data, that is, the temperature data of densitometer 200 when the calibration process was carried out, and those obtained when density of the printed diagnostic image based on diagnostic image data was measured, and detects and acquires the condition change (a difference of temperature) of densitometer 200 based on these temperature data (S10).

Figure 6:
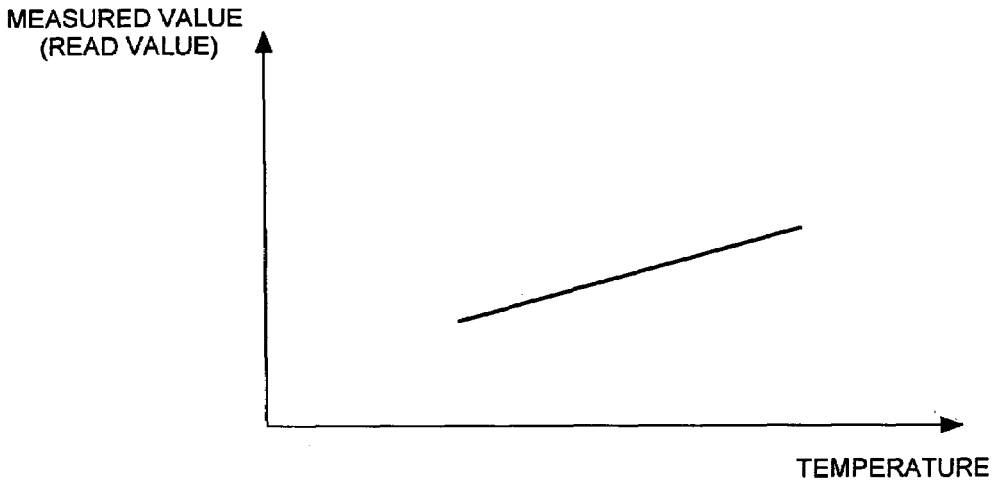
FIG. 6 is a diagram showing an example of the characteristic variation table.

Next, controller 300 acquires a characteristic variation table showing a variation of the measured value caused by the temperature change of densitometer 200 (S20). The characteristic variation table can, for example, be one having the relationship shown in FIG. 6. In FIG. 6, the characteristic variation table is shown as a relational expression showing the relationship between the temperature of densitometer 200 at the time of calibration process and that at the time of the density measurement of the diagnostic image printed based on the diagnostic image data, or a table which has been correlated to show the relationship between both temperature values.

Such a characteristic variation table can be programmed into image processing apparatus 100 as a state in which the table is stored in an appropriate storing means such as ROM, etc. accessible for controller 300 the same as in memory 600 or the like, or it can be provided to image processing apparatus 100 by service personnel or the like when the apparatus is installed, so that controller 300 can read out the table. In the latter case, it can, for example, be realized by installing an interface capable of receiving data in image processing apparatus 100 and by controlling of controller 300 to transfer the data of a characteristic variation table to memory 600 from an appropriate storing medium including data through the interface.

Next, based on the detection result of the condition change acquired in above Step S10, the corresponding variation of density on the characteristic variation table acquired in above Step S20 is determined as the correction value (S30). The determination of the correction value is specifically carried out as follows. When a detected result of condition change which was acquired in Step S10 is "40° C. to 45° C.", for example, and when it is assumed that corresponding density value of "40° C." is "1.2" and that of "45° C." is "1.3", the variation of the measured value being the correction value is determined to be "+0.1", by calculation of "1.3 minus 1.2".

When the correction value-is determined like this, the measured value measured with density meter 200 is read out from memory 600 (S40) and the value is corrected (S50). The correction of the measured value is specifically carried out so that, when the read-out value is "1.9", the corrected value is determined to be "1.8" by subtracting correction value "+0.1" from the measured value of "1.9". The corrected value becomes the final measured value of densitometer 200.

Figure 4:
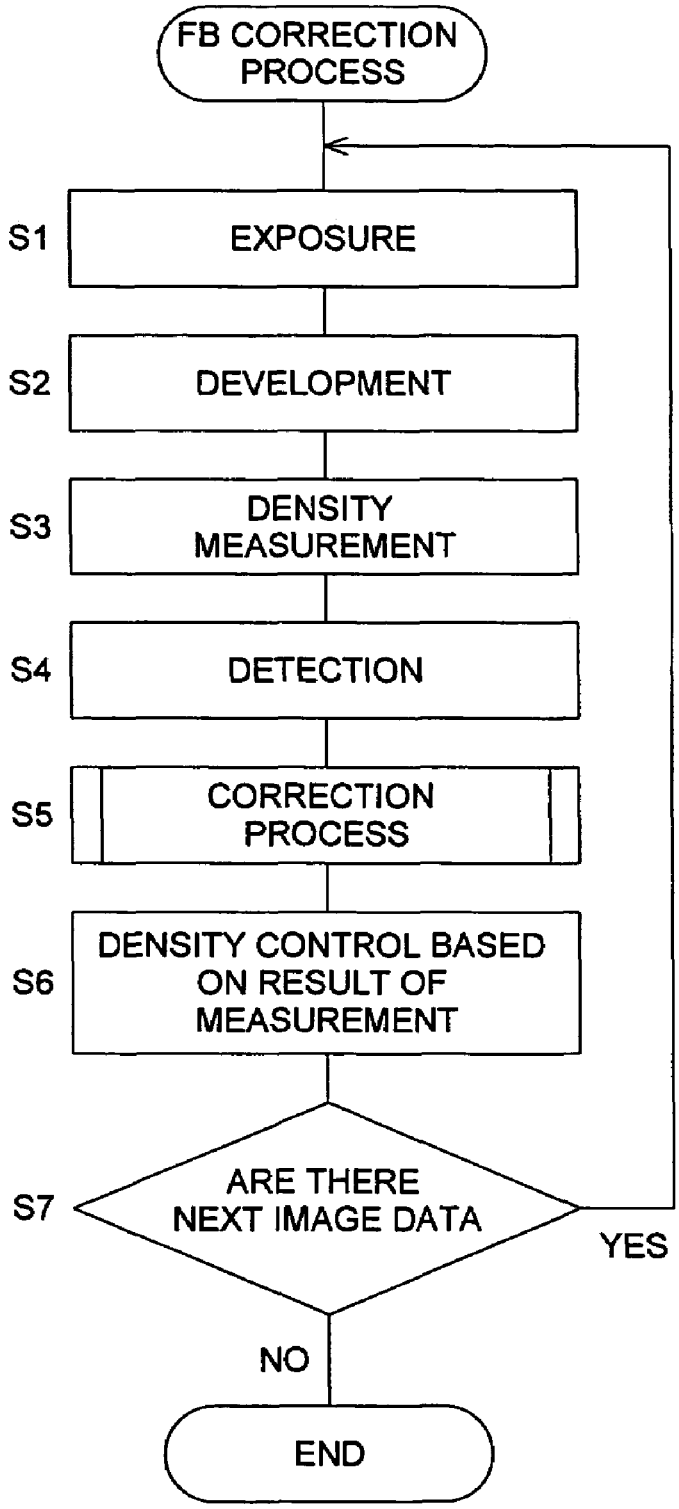
FIG. 4 is a flowchart showing an example of the steps of the FB correction process.

Next, returning to the flowchart in FIG. 4, controller 300 controls image density of the next film to be exposed and developed, based on the corrected measured value of densitometer 200 in the correction process shown in Steps S10-S50 and the diagnostic image data (S6). This control of density can be conducted by means of controlling of controller 300 to at least one of exposure section 120 and developing section 130. The control of density is to determine the exposure amount in exposure section 120 or to determine the developing temperature in developing section 130, as described above.

After control of density by controller 300, it needs to be determined whether or not there is any image to be printed based on diagnostic image data (S7). If there is, the next print based on the diagnostic image data is created to have the same image density determined in above Step S6, in the same manner according to the above Steps S1-S6 while exposure section 120 and/or developing section 130 is/are being controlled. When there is no diagnostic image to be printed, the FB correction is finished.

As shown above, according to the present invention, the measured value of densitometer 200 which has been conducted a calibration process based on the measured value by an external densitometer used as a standard instrument, is corrected corresponding to the condition change (temperature change) of densitometer 200. Therefore, even with a densitometer which is very sensitive to heat, the measured value of densitometer 200 can be corrected to offset any error of the result caused by heat influence and precise control is possible during the FB correction process, and then, constant image density can be maintained by the density control of the FB correction.

In the above explanation, as the condition change of densitometer 200, the aspect to be detected from the temperature difference as a condition change (aspect of temperature) was described, however next, the aspect to be detected from a time difference as a condition change (aspect of time) will be explained.

In the aspect of time, structured as a means to detect the condition of densitometer 200 can be installation of a timer (not illustrated) to measure time, regarding the power-on operation time (heating start time) of image processing apparatus 100 as the starting point, instead of thermometer 700 in FIG. 2.

Figure 7:
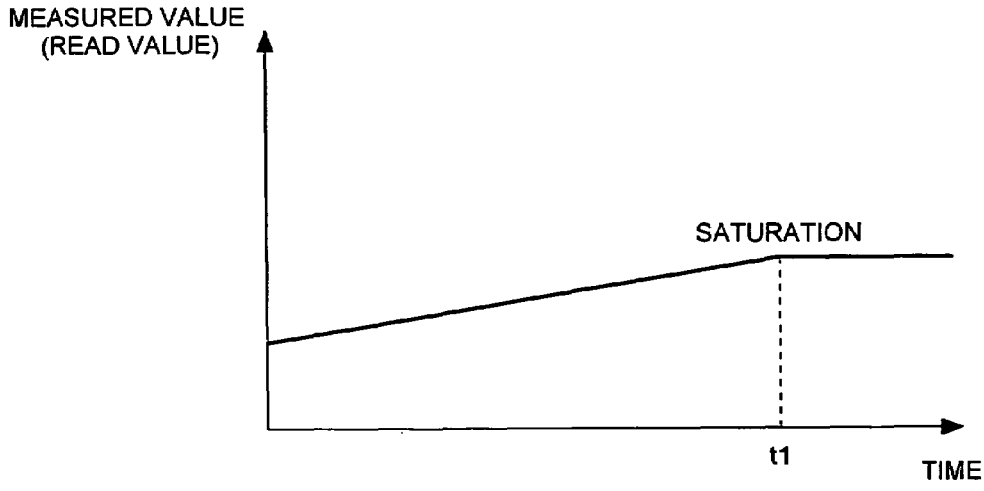
FIG. 7 is a diagram showing an example of the characteristic variation table.

In the case of this aspect of time, instead of the characteristic variation table as shown in FIG. 6, another characteristic variation table can be used indicating the relationship as shown in FIG. 7. The characteristic variation table in FIG. 7 is formed as a relational expression indicating the relationship between the elapsed time after energizing of densitometer 200 and the density value measured on a film sheet having a prescribed density, with densitometer 200 or a correlated table indicating the relationship between both values. "The prescribed density" means a density value previously determined. The graph in FIG. 7 shows that-the measured value of densitometer 200 is variable after the power-on operation because the temperature of the densitometer 200 rises according to the elapsed time (heating time), and that after a specific elapsed time, the temperature becomes stable and the variation of the measured density value disappears (a saturated state).

Figure 5:
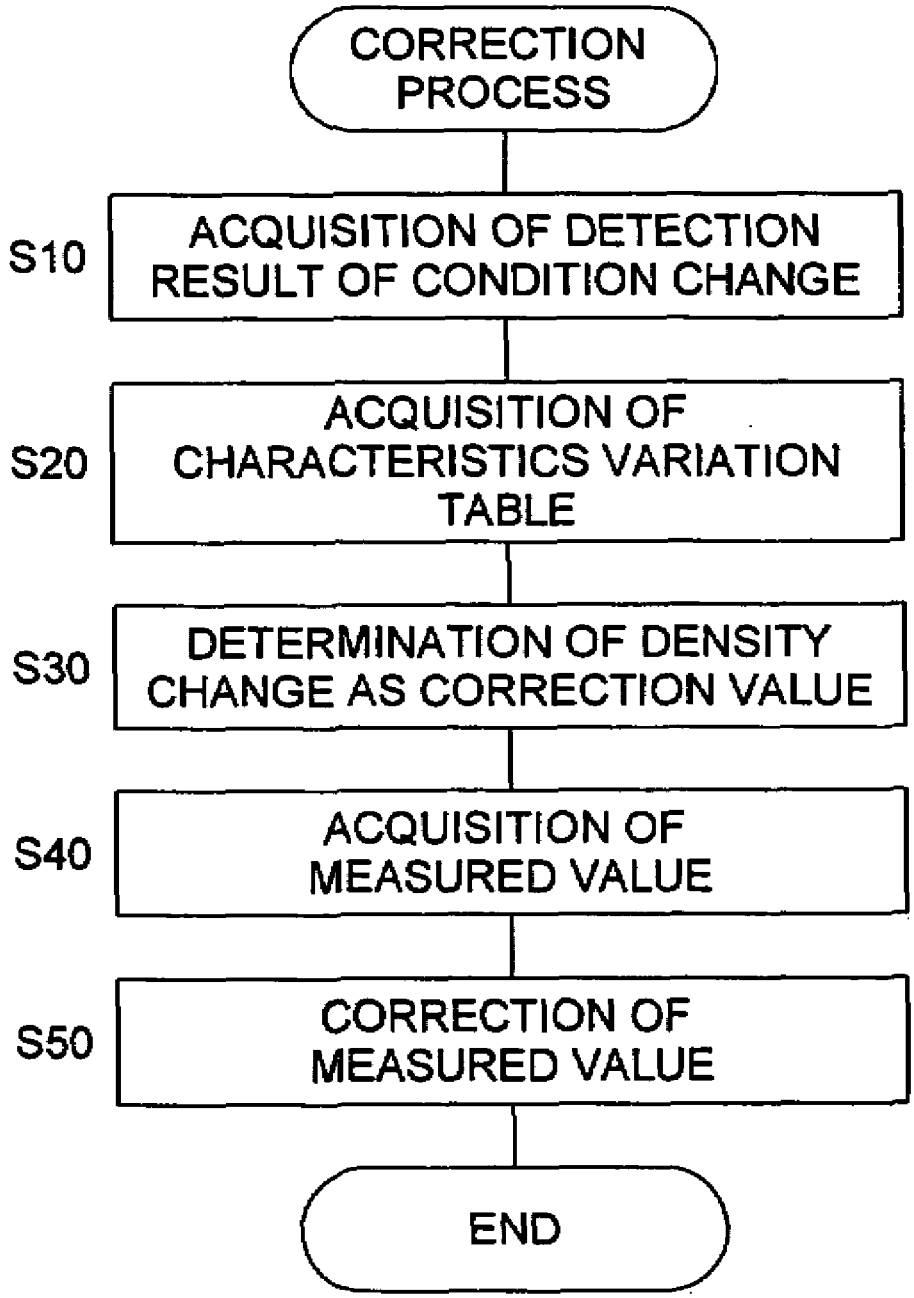
FIG. 5 is a flowchart showing an example of the steps of the correction process.

In the case of aspect of time, the correction process shown in FIG. 5 is carried out the same as in the above aspect of temperature.

Figure 8:
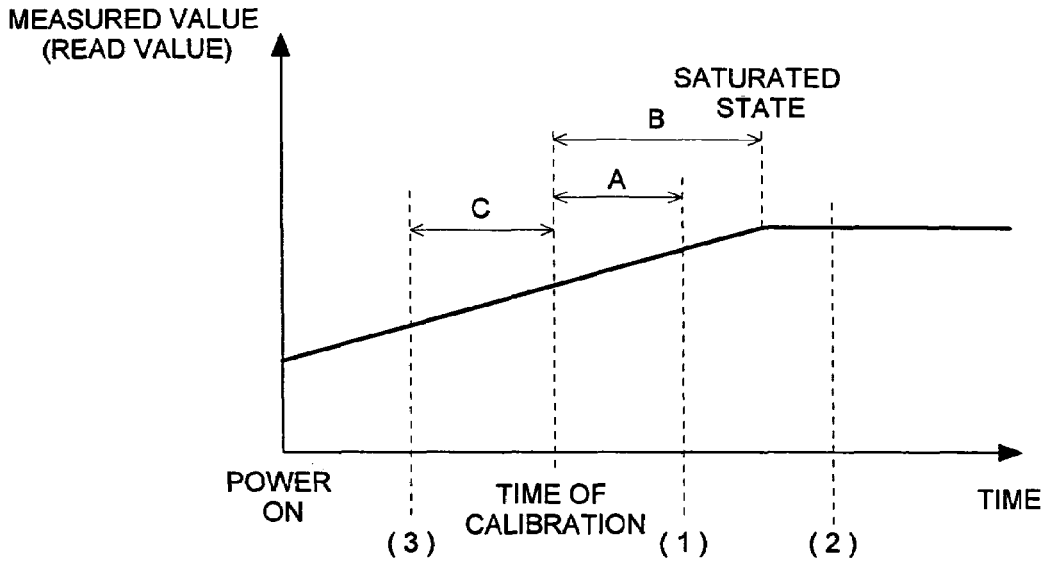
FIG. 8 is a diagram showing an example of the characteristic variation table.

Specifically, on the characteristic variation table shown in FIG. 8, in the case that the time when the image density of film processed based on diagnostic image data was measured, is at point (1), the correction value is determined to be difference "A" which is the difference between the measured value at point (1) and the measured value at the time of the calibration process, and the value corresponding to the above difference "A" is further subtracted from the measured value of densitometer 200, which has been calibrated.

In the case that the time when the image density of a film sheet processed based on diagnostic image data was measured, is at point (2) which is after the saturated state of the measured density, the correction value is determined to be value "B" which is the difference between the measured value at the time of the saturated state and the measured value at the time of the calibration process, and the value corresponding to above difference "B" is further subtracted from the previously calibrated measured value of densitometer 200.

Further, in the case that the time when the image density of film processed based on diagnostic image data was measured is at point (3) which is before the calibration process (for example, the case in which the calibration process is carried out and after this, the power is turned off, and then printing resumes the next day), the correction value is determined to be difference "C" which is the difference between the measured value at the time of the calibration process and the measured value at point (3), and in such a case, the value corresponding to above difference "C" is added to the previously calibrated measured value of densitometer 200.

Figure 9:
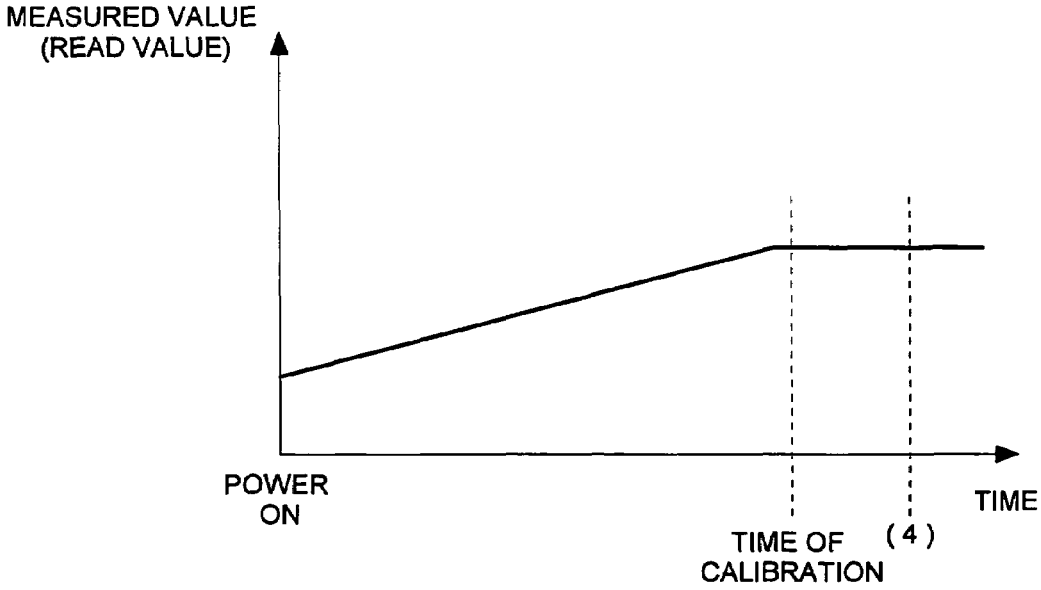
FIG. 9 is a diagram showing an example of the characteristic variation table.

Further, as shown in FIG. 9, in the case that the time of calibration is after the time when the measured density of densitometer 200 has reached the saturated state, and the time when image density of film processed based on diagnostic image data is measured is at point (4) which is after the time of calibration, the correction value is "zero" because the change of the measured density is "zero".

In such aspect of time, it is preferable to perform a time correction process which is conducted to correct the time given by a timer, corresponding to the film processing history.

As the relationship in FIGS. 8 and 9 shows, it is preferable to use densitometer 200 near a point close to the saturated state, which makes correction value of "zero". In such a case, a method in which the calibration process is carried out after the saturation, for example one hour after the power-on of the apparatus can be employed, however it is difficult in reality to make printing for diagnosis images stand by for a long time. Further, it is possible to make plural dummy prints different from diagnosis images and to feed the films through densitometer 200 in order to raise the temperature of densitometer 200 to near the saturated state (semi-saturated state). Problems such as density fluctuation happening during FB correction under the actual use, can be avoided by performing the calibration process at this point and by also employing a method to print diagnostic images in the semi-saturated state (in this case, service personnel or the like can complete his work earlier, and on the next day, the imager is energized as a morning stand-by for example, so that, the temperature reaches the saturated state by the starting time of diagnosis for patients.). According to this invention, however, neither stand-by for a long time after the power-on operation nor plural dummy printing is necessary to print diagnostic images having stable density characteristics by means of the correction process, which exhibits an apparent good effect.

Next, an influence of measured density values caused during the process of calibration of the LUT will be described.

The calibration of the LUT is carried out after any maintenance work is conducted for some parts relating to the image forming process of the imager such as a change of the heat developing drum, or after a film lot change due to changes in film sensitivity. The purpose is to keep the finished image density (including gradation characteristics) uniform corresponding to inputted diagnostic image signals before and after the maintenance work.

Figure 10:
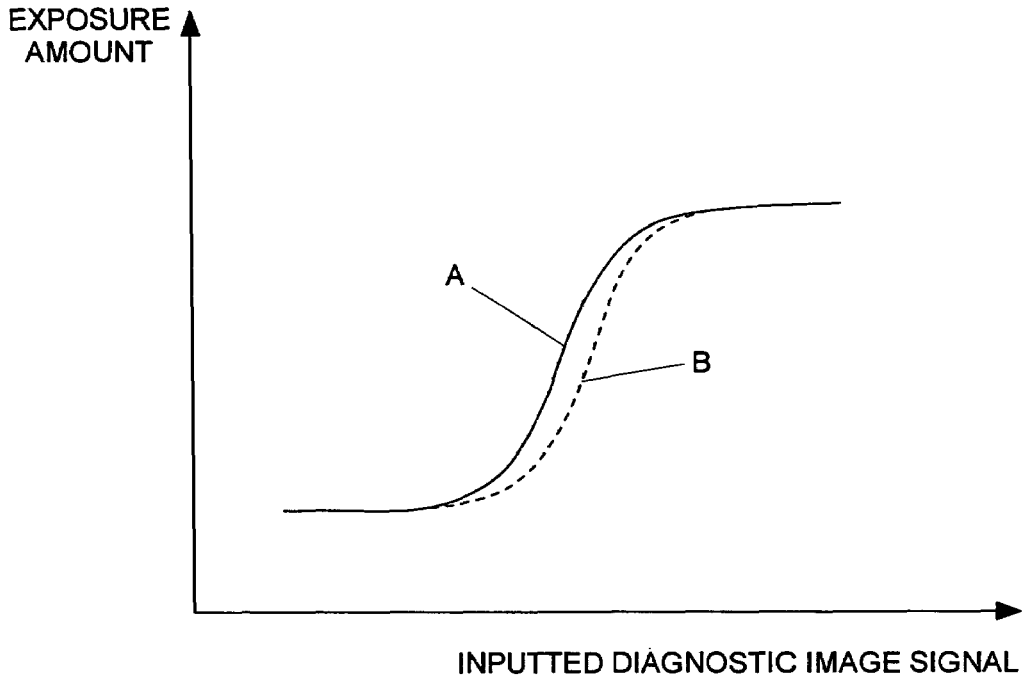
FIG. 10 is a chart showing the relationship between the exposure amount and the inputted diagnostic image signals.

Such calibration of the LUT is carried out based on measured values of densitometer 200 by controller 300 which functions to maintain an appropriate relationship between diagnostic image data and film density, after the calibration of densitometer 200. The relationship between inputted diagnostic image data and exposure amount is determined in the LUT to maintain the gradation characteristics shown as curve "A" in FIG. 10. After this, when all the film sheets have been used to conduct exposure for a latent image and development based on this LUT, a new film package (the same sensitivity) is loaded. When the calibration of the LUT is carried out again, the measured value which densitometer 200 indicates has been shifted toward the higher side because of the heat influence caused by the continuous processing, although the film actually has appropriate gradation characteristics. Accordingly, if an LUT is created by using this upward measured density values, an LUT deviating from the appropriate gradation characteristics, such as curve "B" in FIG. 10 is created so that a difference is made between values of density (gradation) of finished films before and after the change of film sheets having the same sensitivity characteristics. Since medical diagnosis is performed by finding a subtle gradation change in a medical image, the above difference is an important problem.

On the other hand, according to the present invention, the measured value is corrected in consideration of the condition change of densitometer 200 at the time of the calibration of densitometer 200 and at the time of the LUT making, and therefore, the LUT is always preferably created as curve "A" in FIG. 10.

Even in the above calibration process, if the calibration of densitometer 200 is carried out at the saturated state or the semi-saturated state the same as in the FB correction process, it is possible to prevent problem occurrence such as fluctuation of the gradation characteristics in actual use.

The image processing method of the present invention can be realized by controlling by software program (program) previously stored in the prescribed memory such as flush ROM in image processing apparatus 100. In image processing apparatus 100, a microcomputer (computer) including a CPU is installed, and the program of the present invention functions more by being processed by such a computer.

What is claimed is:

1. An image processing apparatus, comprising:

an exposing device to expose a film sheet to form a latent image on the film sheet based on data of a diagnostic image or data of a test image;

a developing device to develop the film sheet exposed by the exposing device to visualize the latent image;

a density measuring device to measure a density value of the film sheet developed by the developing device;

a calibrating device to obtain a calibration value from a calculation process carried out based on a result of density measurement of the test image by the density measuring device and a result of density measurement of the test image by an external density measuring device which is different from the density measuring device and to calibrate the density measuring device according to the calibration value;

a storing device to store a characteristics variation table showing variations of measured values due to a condition change of the density measuring device after a calibration conducted by the calibrating device;

a condition change detecting device to detect a condition change of the density measuring device between when the density value of a film of the diagnostic image is measured and when the calculation process is carried out;

a correcting device to correct a density value of the calibrated density measuring device, according to a result of detection by the condition change detecting device and the characteristics variation table stored in the storing device.

2. The image processing apparatus of claim 1, further comprising:

a controlling device to control at least one of the exposing device and the developing device to optimize a relationship between diagnostic image data and film density according to a density value corrected by the correcting device.

3. The image processing apparatus of claim 2, wherein the controlling device creates a calibration look-up table (LUT) which determines a relationship between the diagnostic image data and a exposure amount and a latent image is formed by the exposing device according to the calibration look-up table (LUT).

4. The image processing apparatus of claim 2, wherein the controlling device controls exposure and development of a printout according to next diagnostic image data by a patch feedback system.

5. The image processing apparatus of claim 2, wherein the developing device is of a heat development type which develops the film sheet by heating to visualize the latent image.

6. The image processing apparatus of claims 1, wherein the condition change of the density measuring device is a temperature change of the density measuring device.

7. The image processing apparatus of claim 1, wherein the condition change of the density measuring device is a time lapse starting from a time at which the density measuring device is energized.

8. The image processing apparatus of claim 7, wherein the correcting device corrects the time lapse according to a history of film processing.

9. An image processing method, comprising steps of:

exposing a film sheet to form a latent image on the film sheet based on data of a diagnostic image or data of a test image;

developing the film sheet exposed in the step of exposing to visualize the latent image;

measuring a density value of the film sheet developed in the step of developing, with a density measuring device;

calibrating the density measuring device, according to a calibration value obtained by a calculation process carried out based on a result of density measurement of the test image by the density measuring device and a result of density measurement of the test image by an external density measuring device which is different from the density measuring device;

detecting a condition change of the density measuring device between when the density value of a film of the diagnostic image is measured and when the calculation process is carried out;

correcting a density value of the density measuring device calibrated in the step of calibrating, according to a result of detection obtained in the step of detecting and a previously stored characteristics variation table showing variations of measured values due to a condition change of the density measuring device after the calibrating step.

10. The image processing method of claim 9, further comprising step of:

controlling at least one of the exposing device and the developing device to optimize a relationship between diagnostic image data and film density according to a density value corrected in the step of correcting.

11. The image processing method of claim 10, wherein in the step of controlling, a calibration look-up table (LUT) which determines a relationship between diagnostic image data and an exposure amount is created and a latent image is formed according to the calibration look-up table in the step of exposing.

12. The image processing method of claim 10, wherein in the step of controlling, exposure and development of a printout are controlled according to next diagnostic image data by a patch feedback system.

13. The image processing method of claim 9, wherein the step of developing, a developing device of a heat development type is employed, which develops the film sheet by heating to visualize the latent image.

14. The image processing method of claim 9, wherein the condition change of the density measuring device is a temperature change of the density measuring device.

15. The image processing method of claim 9, wherein the condition change of the density measuring device is a time lapse starting from a time at which the density measuring device is energized.

16. The image processing method of claim 15, wherein in the step of correcting, the time lapse is corrected according to a history of film processing.

17. An image processing program for implementing an image processing method of claim 9, stored in an image processing apparatus.

* * * * *